US005218334A

United States Patent [19]

Bartlett

[11] Patent Number: 5,218,334

[45] Date of Patent: Jun. 8, 1993

[54] SURFACE MOUNTABLE HIGH CURRENT RESISTOR

[75] Inventor: Michael H. Bartlett, Coral Springs, Fla.

[73] Assignee: Motorola, Inc., Schaumburg, Ill.

[21] Appl. No.: 901,309

[22] Filed: Jun. 19, 1992

[51] Int. Cl.[5] ..... H01C 3/02

[52] U.S. Cl. ..... 338/61; 338/206; 338/293; 338/297; 338/330

[58] Field of Search ..... 338/61, 62, 63, 330, 338/333, 293, 297, 206, 315, 325

[56] References Cited

U.S. PATENT DOCUMENTS

| | | | |
|---|---|---|---|
| 2,744,987 | 5/1956 | Marvin | 338/293 X |
| 4,317,104 | 2/1982 | Bergmann et al. | 338/330 |
| 4,395,586 | 7/1983 | Eiermann et al. | 338/315 X |
| 4,617,548 | 10/1986 | Buchwald et al. | 338/325 |
| 5,034,721 | 7/1991 | Benedictus | 338/284 |
| 5,087,897 | 2/1992 | Suarez | 331/117 R |

*Primary Examiner*—Marvin M. Lateef
*Attorney, Agent, or Firm*—Dale W. Dorinski

[57] ABSTRACT

A surface mountable, high current resistor (20) is formed generally in the shape of an inverted "U". The top portion (22) of the inverted "U" is flat and contains one or more openings (26, 27) that serve to alter the resistivity of the resistor. The openings are formed so as to be inverted mirror images of each other, thereby cancelling inductive effects introduced by the openings. The ends of the "U" are formed into two or more legs (24) that serve to provide stability and a mounting area for soldering the resistor to a printed circuit board. A flat, unbroken portion (28) in the center of the resistor serves as a convenient area to handle the resistor with a vacuum tool during printed circuit assembly.

18 Claims, 3 Drawing Sheets

SURFACE MOUNTABLE HIGH CURRENT RESISTOR

TECHNICAL FIELD

This invention relates generally to electrical resistors and in particular to electrical resistors useful for high current applications with printed circuit boards.

BACKGROUND

Certain types of electrical circuits require the use of resistors that are able to handle high levels of current and produce a low resistance. Standard types of resistors such as carbon composition or wire wound resistors are limited in their ability to handle high current. One alternate method of providing a high current, low resistance resistor is to place a metal jumper on the printed circuit board in place of a conventional resistor. The metal jumper is typically fabricated from a metal alloy that has a higher resistance than the remaining portions of the circuit and serves to provide a low resistance, high current component. The metal alloy is selected to provide a constant resistance over temperature. These types of resistors are typically made from strips or wires of the metal alloy. The resistors end up looking much like staples and are typically used in printed circuit boards having thru-hole configurations. The resistance of the resistor is changed by varying the thickness of the strip or wire.

While this type of resistor works well in applications having thru-hole circuit boards applications, it is difficult to use with surface mount circuit boards. The small legs of the staple provide minimal area for the solder to form a fillet, and the staples are difficult to package and handle in high-speed auto placement equipment. In addition, this configuration is mechanically unstable unless it is anchored to the printed circuit board. Prior to soldering, it is difficult if not impossible to keep the staple type of wire resistor in proper orientation. Without the aid of a hole or other mechanical stabilizing means, the staple falls over prior to soldering.

It would be desirable if a high current, low resistance, surface mountable resistor could be provided that could be easily packaged and handled by auto placement equipment. In addition, it would be highly desirable if the resistor could be stable so as to usable in surface mount configurations.

SUMMARY OF THE INVENTION

Briefly, according to the invention, a surface mountable electrical resistor is provided, having a low resistance and high current capability. The resistor comprises a metal stamping having an electrically resistant characteristic. The metal stamping has a resistive portion and at least two legs attached to the flat portion. Each leg serves to provide electrical connection and mounting to a printed circuit board. The flat portion is formed into a pattern by providing one or more slots or openings in it.

In another embodiment, the slots or openings in the resistive portion are formed in the shape of complimentary, interdigitated, spirals so as to minimize or cancel any inductive effect that the slots or openings may cause in the resistor.

In a further embodiment of the present invention, the high current, low resistance resistor has four legs, each of which are perpendicular to the resistor portion and each leg is formed into a right angle so as to provide a foot usable for surface mounting and soldering.

DETAILED DESCRIPTION OF THE PREFERRED EMBODIMENT

Figure 1:
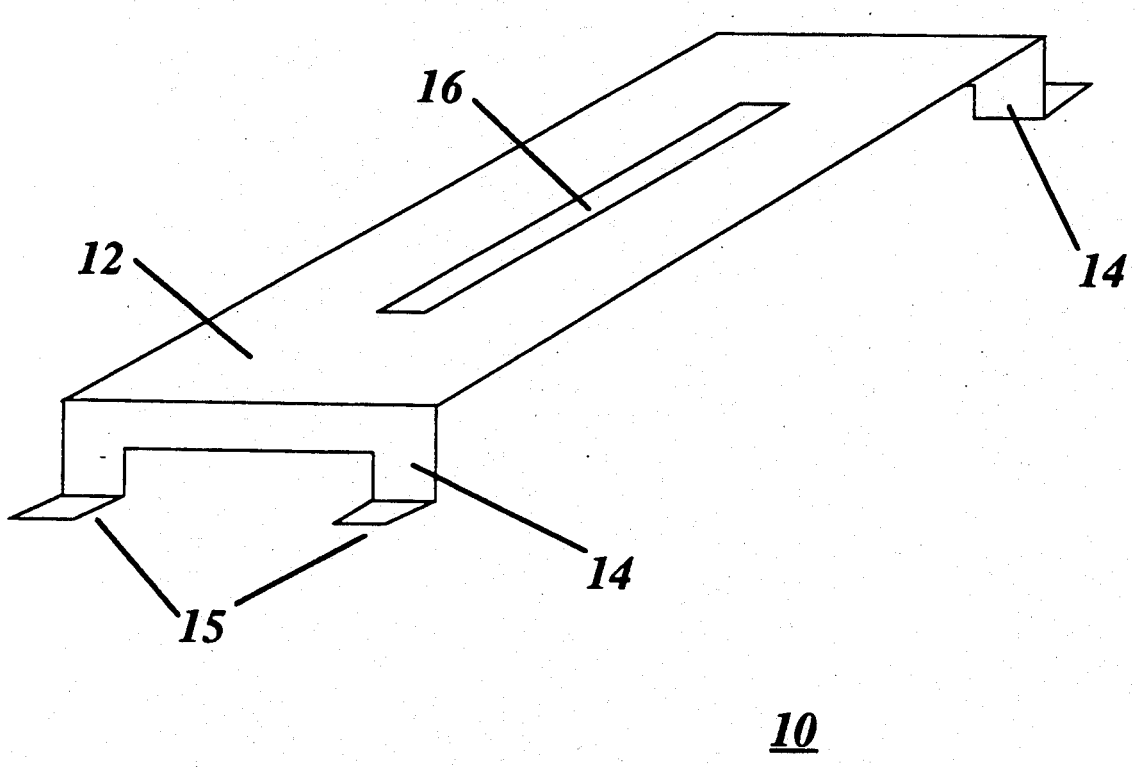
FIG. 1 is an isometric view of a high current resistor in accordance with the present invention.

Referring now to FIG. 1, an isometric view of one embodiment of the invention, a high current, low resistance resistor 10 is formed from a sheet of a metal alloy having a given resistance. Examples of some metal alloys that may typically be used are nichrome, chrome, nickel, copper, steel, stainless steel, alloy 42, kovar, constantan, and other alloys that have characteristics of uniform resistance over a 200°-300° C. temperature range. The metal sheet is typically formed in the shape of an inverted "U." The top or horizontal portion 12 serves as a major resistive area for the resistor 10. The remaining portions or legs 14 of the metal sheet are bent approximately perpendicular the top portion 12 so as to provide a mounting portion for the resistor 10. A minimum of two legs is required on each resistor but additional legs may be added as the user requires. For example, the resistor 10 shown in FIG. 1 has four legs 14 attached to the top portion 12. Each leg 14 can additionally be formed further to provide a foot 15 at the base of each leg to aid in soldering the resistor to a printed circuit board. The foot 15 is typically made solderable and optionally, a portion of the leg 14 may also be made solderable.

In a simple configuration, shown in FIG. 1, the top portion 12 contains one slot or opening 16. This opening serves to modify the resistance of the resistor 10 by changing the characteristic of the resistor from bulk resistance to a sheet resistance. The concept of sheet resistance is well known to those skilled in the art and is widely employed in thick and in film applications. By providing openings 16 in the surface 12 of the resistor 10, the resistance can be increased. Numerous configurations of slots and openings 16 can be utilized to alter the resistance.

Figure 2:
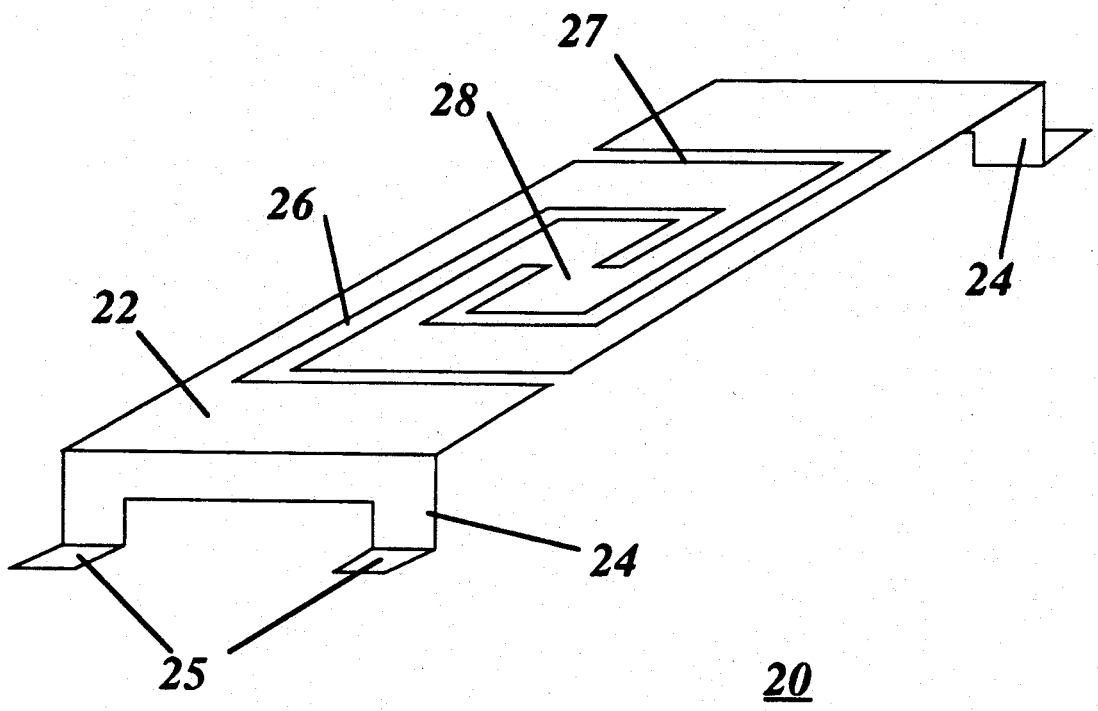
FIG. 2 is an isometric view of another embodiment of the invention.

FIG. 2 shows a preferred embodiment of the invention where a slot or first opening 26, resembling a partially spiral shape, is formed in a resistive surface 22 of the resistor 20. The exact configuration of the opening can be altered to suit the needs of the user but, typically, a squared off shape is employed because it is easier to manufacture and stamp such a shape into the metal sheet. A second opening 27 is also included in the resistive surface 22. However, the second opening 27 is an inverted mirror image of the opening 26. That is to say, it is similar to the first opening 26 but complimentary. The purpose of providing the inverted mirror image second opening 27 complimentary to the first opening 26 is to minimize or cancel any inductive effects that the first opening may create. The ability to reduce or cancel inductive effects in a resistor is very important in those applications where added inductance may adversely affect the functioning of the electrical circuit.

Figure 3:
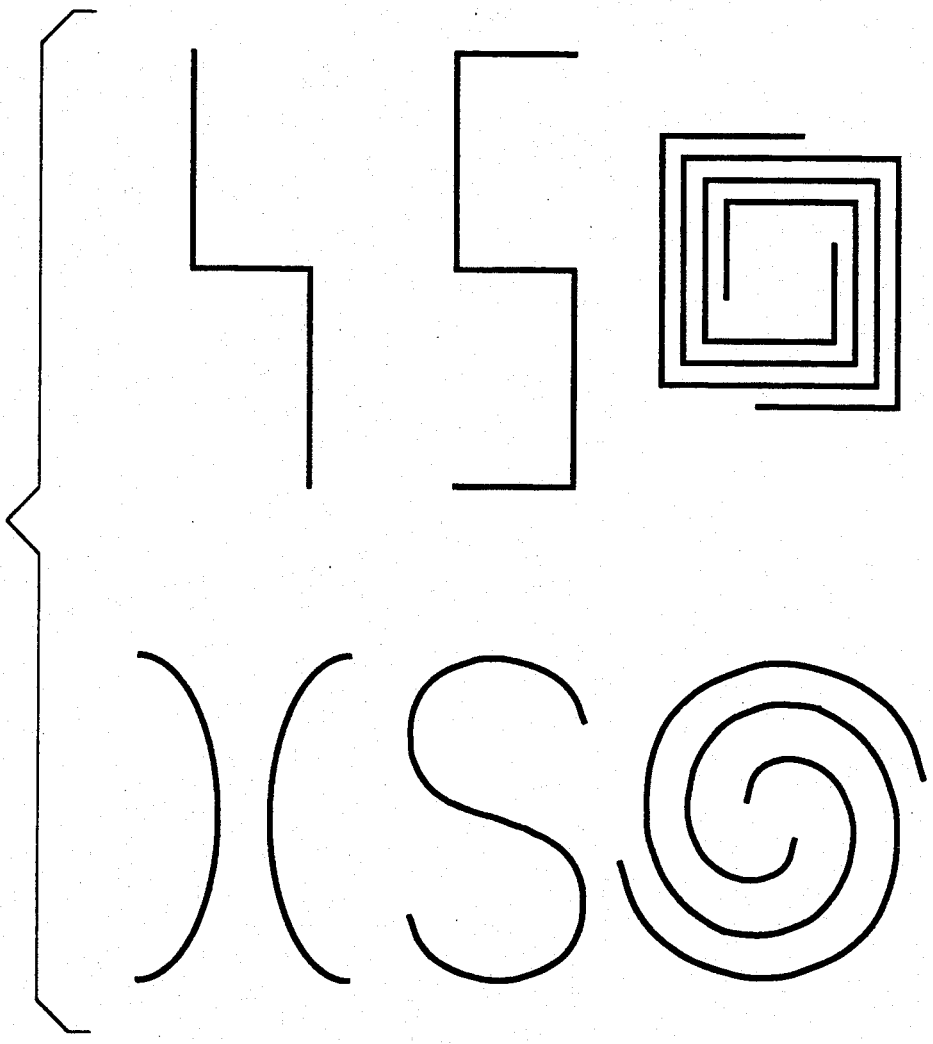
FIG. 3 is a plan view of typical opening patterns formed in the resistor.

Other shapes of openings 26 and 27 may also be placed into the resistive surface 22 of the resistor 20, for example, S-shaped openings, or openings in the shape of a squared off sine or tangent wave may also be used. Examples of some typical openings may be found in FIG. 3.

Proper selection of the shape and placement of the openings 26 and 27 in the resistor 20 will allow one to leave an unbroken or solid portion 28 at the approximate center of the resistive surface 22 of the resistor. This solid portion can be quite useful during assembly of the printed circuit board. An automated assembly station or robot can easily pick up the resistor from a component feeding station by using a vacuum tip that contacts the resistor in the solid or unbroken center portion 28 of the resistive surface 22. This is not feasible when using the conventional art where the resistor is very narrow and does not lend itself to standing upright. In addition, the legs 24 and feet 25 of the resistor allow it to stand upright. Once placed on the board, the legs 24 also serve to provide additional stability and maintain the resistor 20 in the position it was placed. In addition, the legs 24 serve to elevate the resistive portion 22 of the resistor above the mounting plane of the printed circuit board, thereby enhancing the thermal performance of the resistor.

The resistive value of the resistor 20 can be altered by modifying the shape or extent of the openings 26 and 27. If the spiral pattern of openings 26 and 27 is continued further, the resistance will be increased. Reducing the extent of the spiral in openings 26 and 27 will lower the resistance. Typically, these resistors are made by use of a progressive die and the openings are stamped out in a series of progressive steps. By altering the steps in the progressive die, the openings sizes and shapes can be easily altered without having to provide additional hard tooling such as new dies.

While the accompanying drawing figures reflect particular embodiments of the invention, they are not meant to limit the scope or spirit of the invention. Accordingly, the invention is only meant to be limited as noted in the appended claims.

What is claimed is:

1. A surface mountable electrical resistor, comprising:

a metal stamping having an electrically resistive characteristic, the metal stamping having a major surface and at least two legs, each leg serving to provide electrical connection and formed into a right angle so as to provide a surface mountable portion to a printed circuit board and;

the major surface being formed into a pattern by means of one or more openings formed in the major surface.

2. The surface mountable electrical resistor as described in claim 1, wherein the openings formed in the major surface comprise one or more squared spiral patterns.

3. The surface mountable electrical resistor as described in claim 1, wherein the openings formed in the major surface comprise one or more openings formed generally in the shape of a "S".

4. The surface mountable electrical resistor as described in claim 1, wherein the pattern comprises two complimentary spiral patterns.

5. The surface mountable electrical resistor as described in claim 1, wherein the metal stamping is selected from the group consisting of nichrome, steel, copper, chrome, stainless steel, alloy 42, nickel, constantan, and kovar.

6. The surface mountable electrical resistor as described in claim 1, wherein the pattern provides an inductance canceling effect to the resistor.

7. The surface mountable electrical resistor as described in claim 1, wherein the metal stamping has four legs, one leg at each corner of the stamping.

8. The surface mountable electrical resistor as described in claim 1, wherein the metal stamping is generally in the shape of an inverted "U".

9. A surface mountable electrical resistor, comprising an electrically resistive metal sheet formed generally in the shape of an inverted "U", the metal sheet having a primary resistive portion and at least two leg portions, each leg portion having a solderable mounting portion for attachment to a printed circuit board, the primary resistive portion having one or more openings formed in a major surface, the openings being shaped to minimize inductance in the resistor.

10. The surface mountable electrical resistor as described in claim 9, wherein the openings formed in the major surface comprise one or more squared spiral patterns.

11. The surface mountable electrical resistor as described in claim 9, wherein the openings formed in the major surface comprise one or more patterns formed generally in the shape of a "S".

12. The surface mountable electrical resistor as described in claim 11, wherein the pattern comprises two complimentary spiral patterns.

13. The surface mountable electrical resistor as described in claim 9, wherein the metal sheet is selected from the group consisting of nichrome, steel, copper, chrome, stainless steel, alloy 42, nickel, constantan, and kovar.

14. The surface mountable electrical resistor as described in claim 9, wherein the metal sheet has four legs, one leg at each corner of the stamping.

15. A surface mountable electrical resistor, comprising a nichrome strip formed generally in the shape of an inverted "U", the nichrome strip having a primary resistive portion and four legs substantially perpendicular to the resistive portion, each leg having a solderable mounting portion for attachment to a printed circuit board, the primary resistive portion having a solid portion at a center and one or more openings formed in a major surface, the openings being shaped and arranged to produce inductive canceling of the resistor.

16. The surface mountable electrical resistor as described in claim 15, wherein the openings formed in the primary resistive portion comprise one or more squared spiral patterns.

17. The surface mountable electrical resistor as described in claim 16, wherein the squared spiral pattern comprises two complimentary spiral patterns.

18. The surface mountable electrical resistor as described in claim 15, wherein the openings formed in the primary resistive portion comprise one or more patterns formed generally in the shape of a "S".

* * * * *